US009290831B2

(12) United States Patent
Yoshizawa et al.

(10) Patent No.: US 9,290,831 B2
(45) Date of Patent: Mar. 22, 2016

(54) SOFT-MAGNETIC, AMORPHOUS ALLOY RIBBON AND ITS PRODUCTION METHOD, AND MAGNETIC CORE CONSTITUTED THEREBY

(75) Inventors: Yoshihito Yoshizawa, Mishima-gun (JP); Naoki Ito, Mishima-gun (JP); Shinichi Kazui, Kumagaya (JP); Makoto Sasaki, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 509 days.

(21) Appl. No.: 13/392,427

(22) PCT Filed: Sep. 14, 2010

(86) PCT No.: PCT/JP2010/065866

§ 371 (c)(1),
(2), (4) Date: Feb. 24, 2012

(87) PCT Pub. No.: WO2011/030907

PCT Pub. Date: Mar. 17, 2011

(65) Prior Publication Data

US 2012/0154084 A1 Jun. 21, 2012

(30) Foreign Application Priority Data

Sep. 14, 2009 (JP) ..... 2009-212355

(51) Int. Cl.
*C21D 1/34* (2006.01)
*H01F 3/04* (2006.01)
(Continued)

(52) U.S. Cl.
CPC ..... *C22C 38/02* (2013.01); *C22C 45/02* (2013.01); *H01F 1/15341* (2013.01); *H01F 41/0226* (2013.01); *Y10T 29/49078* (2015.01); *Y10T 428/12389* (2015.01)

(58) Field of Classification Search
CPC ..... C21D 8/1294; C21D 8/12; C21D 8/1277; C22C 45/02
USPC ..... 148/304, 121
See application file for complete search history.

(56) References Cited

U.S. PATENT DOCUMENTS

| | | | |
|---|---|---|---|
| 4,685,980 | A | 8/1987 | Sato et al. |
| 5,338,373 | A | 8/1994 | VonHoene et al. |
| 2009/0145526 | A1 | 6/2009 | Arai et al. |

FOREIGN PATENT DOCUMENTS

| | | | |
|---|---|---|---|
| JP | 57-161031 | A | 10/1982 |
| JP | 61-029103 | A | 2/1986 |

(Continued)

OTHER PUBLICATIONS

Tan et al. IEEE Transaction on Magnetics, 1986, vol. MAG-22, p. 188-191.*

(Continued)

*Primary Examiner* — Jie Yang
*Assistant Examiner* — Xiaowei Su
(74) *Attorney, Agent, or Firm* — Sughrue Mion, PLLC

(57) ABSTRACT

A soft-magnetic, amorphous alloy ribbon produced by a rapid quenching method, having transverse lines of recesses formed on its surface by laser beams with predetermined longitudinal intervals, with a doughnut-shaped projection formed around each recess; doughnut-shaped projections having smooth surfaces substantially free from splashes of the alloy melted by the irradiation of laser beams, and a height $t_2$ of 2 μm or less; and a ratio $t_1/T$ of the depth $t_1$ of the recesses to the thickness T of the ribbon being in a range of 0.025-0.18, thereby having low iron loss and low apparent power.

16 Claims, 7 Drawing Sheets

(51) Int. Cl.

| | |
|---|---|
| ***C22C 38/02*** | (2006.01) |
| ***C22C 45/02*** | (2006.01) |
| ***H01F 1/153*** | (2006.01) |
| ***H01F 41/02*** | (2006.01) |

(56) References Cited

FOREIGN PATENT DOCUMENTS

| | | | |
|---|---|---|---|
| JP | 62-049964 | B2 | 10/1987 |
| JP | 02-053935 | B2 | 11/1990 |
| JP | 03-032886 | A | 5/1991 |
| JP | 03-032888 | B2 | 5/1991 |
| JP | 07-086788 | A | 3/1995 |
| JP | 2001-181804 | A | 7/2001 |
| JP | 2006-045662 | A | 2/2006 |
| JP | 2007-002334 | A | 1/2007 |
| WO | 9304538 | A1 | 3/1993 |

OTHER PUBLICATIONS

Machine translation of JP2007002334A, Jan. 2007.*
Sato, Journal of Materials Engineering and Performance, 1993, vol. 2, p. 235-240.*
Extended European Search Report dated May 8, 2014, issued by the European Patent Office in corresponding European Application No. 10815497.2.

* cited by examiner

SOFT-MAGNETIC, AMORPHOUS ALLOY RIBBON AND ITS PRODUCTION METHOD, AND MAGNETIC CORE CONSTITUTED THEREBY

CROSS REFERENCE TO RELATED APPLICATION

This application is a National Stage of International Application No. PCT/JP2010/065866, filed on Sep. 14, 2010, claiming priority based on Japanese Patent Application No. 2009-212355, filed Sep. 14, 2009, the contents of all of which are incorporated herein by reference in their entirety.

FIELD OF THE INVENTION

The present invention relates to a soft-magnetic, amorphous alloy ribbon with low loss and apparent power and a high lamination factor and suitable for distribution transformers, high-frequency transformers, saturable reactors, magnetic switches, etc., its production method, and a magnetic core constituted by such soft-magnetic, amorphous alloy ribbon.

BACKGROUND OF THE INVENTION

Soft-magnetic, Fe- or Co-based, amorphous alloys produced by liquid quenching methods such as a single roll method, etc. are free from magnetocrystalline anisotropy because of no crystal grains, having small magnetic hysteresis loss, low coercivity and excellent soft magnetic properties. Because of these properties, amorphous alloy ribbons are used in magnetic cores for various transformers, choke coils, saturable reactors and magnetic switches, magnetic sensors, etc. Particularly, Fe-based, amorphous alloy ribbons have relatively high saturation magnetic flux densities Bs, low coercivity, and low loss, gathering much attention as energy-saving, soft-magnetic materials. Among the Fe-based, amorphous alloy ribbons, amorphous Fe—Si—B alloy ribbons having excellent thermal stability are widely used in transformer cores (see, for example, JP 2006-45662 A).

Though amorphous Fe—Si—B alloys have low coercivity and small magnetic hysteresis loss, it is known that their eddy current loss (iron loss-hysteresis loss) in a broad sense is larger than a classical eddy current loss determined under the assumption of uniform magnetization by tens of times to about 100 times. The difference between the broad-sense eddy current loss and the classical eddy current loss is called anomalous eddy current loss or excess loss, which is mainly caused by non-uniform magnetization change. Large anomalous eddy current loss in this amorphous alloy is presumably due to the fact that magnetic domains in the amorphous alloy have large width, resulting in a high speed of domain wall displacement, and thus a large speed of the non-uniform magnetization change.

Known as methods for reducing anomalous eddy current loss in amorphous alloy ribbons are a method of mechanically scratching a surface of an amorphous alloy ribbon (JP 62-49964 B), and a laser-scribing method of irradiating a surface of an amorphous alloy ribbon with laser beams to cause local melting and rapid solidification, thereby dividing magnetic domains (JP 3-32886 B, JP 3-32888 B and JP 2-53935 B).

In the method of JP 3-32886 B for dividing magnetic domains, an amorphous alloy ribbon surface is melted locally and instantaneously by the irradiation of laser pulses in a transverse direction, and then rapidly solidified to form substantially circular recesses in lines. Each recess has a diameter of 0.5 mm or less, particularly 200-250 μm when the recesses are formed before annealing, and 50-100 μm when they are formed after annealing. The recesses have an average interval of 1-20 mm. In a diameter range of 50-250 μm, the iron loss decreases as the diameter increases. With respect to the relation between iron loss and ribbon thickness, the thinner the ribbon, the smaller the iron loss, and a thinner ribbon provides a smaller iron loss-reducing effect by the irradiation of laser pulses, 40-50% at the thickness of 60 μm, and about 10-20% at the thickness of 30 μm or less. In Example 1 of JP 3-32886 B, recesses having diameters of about 50-250 μm are formed with 5-mm intervals by a YAG laser on a 65-μm-thick, amorphous alloy ribbon.

Molten alloy splashes are observed around recesses formed by the method of JP 3-32886 B. This appears to be due to the fact that to form recesses with large intervals on a relatively thick amorphous alloy ribbon, deep recesses are formed by a large irradiation energy density of laser beams. It has been found, however, that when deep recesses are formed at such a large irradiation energy density of laser beams that splashes are formed around the recesses, particularly a relatively thin amorphous alloy ribbon would suffer increase in apparent power (exciting VA) and decrease in a space factor despite the decreased iron loss. Increase in the apparent power of the amorphous alloy ribbon results in larger sound noise when used for distribution transformers, etc. The space factor has the same meaning as a lamination factor LF, smaller LF providing larger ribbon-laminated cores. Increase in the apparent power and decrease in the lamination factor have more serious problems on thinner amorphous alloy ribbons, because thinner amorphous alloy ribbons are more influenced by laser-scribed surface conditions than thicker amorphous alloy ribbons.

The method of JP 3-32888 B for dividing magnetic domains comprises the steps of irradiating an amorphous alloy ribbon with laser pulses having a beam diameter of 0.5 mm or less with an energy density of 0.02-1.0 J/mm$^2$ per one pulse in a transverse direction, so that an amorphous alloy ribbon surface is locally and instantaneously melted and rapidly solidified, thereby forming substantially circular recesses at a line density of 10% or more, and annealing the ribbon. This method is an improvement of the method of JP 3-32886 B, optimizing the distribution density of recesses and the timing of annealing to improve iron loss and exciting properties. In Example 1 of JP 3-32888 B, a 65-μm-thick, amorphous alloy ribbon is irradiated with laser pulses having a beam diameter of 0.2 mm and an energy density of about 0.3 J/mm$^2$, which is supplied from a YAG laser, to form lines of recesses at line density of about 70%. However, molten alloy splashes are observed around recesses shown in JP 3-32888 B. This seems to be due to the fact that deep recesses are formed by a large irradiation energy density of laser beams. As a result, the apparent power increases despite the decreased iron loss.

JP 3-32888 B describes an energy density of 0.02-1.0 J/mm$^2$ per one pulse. However, when laser pulses having as low energy as near 0.02 J/mm$^2$ are projected to an amorphous alloy ribbon as thick as 65 μm, the resultant recesses are not fully deep relative to the thickness of the amorphous alloy ribbon, failing to obtain a sufficient iron loss-reducing effect.

The method of JP 2-53935 B is the same as those described in JP 3-32886 B and JP 3-32888 B, in that an amorphous alloy ribbon is irradiated with laser beams in a transverse direction to melt the surface locally. However, the former is different from the latter in that molten portions are crystallized regions. The crystallized regions are formed by the scanning of laser beams, etc., a ratio d/D of their depth d to the thickness D of the amorphous alloy ribbon being 0.1 or more, and the percentage of the crystallized regions being 8% or less by volume based on the entire ribbon. However, because the molten portions are crystallized regions, the iron loss is not sufficiently reduced.

OBJECT OF THE INVENTION

Accordingly, an object of the present invention is to provide a soft-magnetic, amorphous alloy ribbon having low iron loss and apparent power as well as a high lamination factor, its production method, and a magnetic core constituted by such soft-magnetic, amorphous alloy ribbon.

SUMMARY OF THE INVENTION

As a result of intensive research in view of the above object, it has been found that in the formation of amorphous recesses in lines of dots by irradiating a surface of a soft-magnetic, amorphous alloy ribbon with laser beams in a transverse direction with predetermined longitudinal intervals, it is possible to reduce iron loss while suppressing increase in apparent power with a lamination factor kept high, by controlling the irradiation conditions of laser beams such that annular projections formed around the recesses are doughnut-shaped projections having smooth surfaces substantially free from splashes of the alloy melted by the irradiation of laser beams, that the height $t_2$ of the annular projections is 2 μm or less, and that a ratio $t_1/T$ of the depth $t_1$ of the recesses to the thickness T of the ribbon is in a range of 0.025-0.18. The present invention has been completed based on such finding.

The soft-magnetic, amorphous alloy ribbon of the present invention is formed by a rapid quenching method, and has transverse lines of recesses formed on its surface by laser beams with predetermined longitudinal intervals, with a doughnut-shaped projection formed around each recess; the doughnut-shaped projections having smooth surfaces substantially free from splashes of the alloy melted by the irradiation of laser beams, and a height $t_2$ of 2 μm or less; and a ratio $t_1/T$ of the depth $t_1$ of the recesses to the thickness T of the ribbon being in a range of 0.025-0.18, thereby having low iron loss and low apparent power.

The openings of the recesses are preferably substantially circular. The height $t_2$ of the doughnut-shaped projections is preferably 0.5-2 μm, more preferably 0.5-1.8 μm. A ratio $t_1/T$ of the depth $t_1$ of the recesses to the thickness T of the ribbon is preferably in a range of 0.03-0.15.

The thickness T of the ribbon is preferably 30 μm or less. When the thickness T of the ribbon is 30 μm or less, the $t_1/T$ ratio can be made small, suppressing increase in the apparent power.

A ratio t/T of the total t of the depth $t_1$ of the recesses and the height $t_2$ of the doughnut-shaped projections to the thickness T of the ribbon is preferably 0.2 or less, more preferably 0.16 or less.

Because Fe—Si—B alloy ribbons are resistant to embrittlement by laser scribing, the soft-magnetic, amorphous alloy ribbon is preferably made of an Fe—Si—B alloy.

A surface of the amorphous alloy ribbon, which is irradiated with laser beams, preferably has reflectance of 15-80% at a wavelength λ of 1000 nm. The term "reflectance" used herein means a ratio of laser beams reflected in an incident direction to incident laser beams, when the laser beams are vertically projected to the alloy ribbon surface. Accordingly, the reflectance of 10% means that 10% of laser beams are reflected in the incident direction, and that the total of laser beams diffuse-reflected to other directions and those absorbed by the alloy ribbon is 90%. With reflectance in this range, the irradiation energy density of laser beams is not excessively large or small, easily forming recesses surrounded by doughnut-shaped projections having smooth surfaces substantially free from molten alloy splashes.

The method of the present invention for producing a soft-magnetic, amorphous alloy ribbon having low iron loss and low apparent power comprises irradiating a surface of a soft-magnetic, amorphous alloy ribbon produced by a rapid quenching method with laser beam pulses successively in a transverse direction with predetermined longitudinal intervals, to form transverse lines of recesses; the irradiation energy density of the laser beam pulses being controlled, such that (a) a doughnut-shaped projection is formed around each recess, that (b) the doughnut-shaped projections have substantially no molten alloy splashes to have smooth surfaces, that (c) the doughnut-shaped projections have a height $t_2$ of 2 μm or less, and that (d) a ratio $t_1/T$ of the depth $t_1$ of the recesses to the thickness T of the ribbon is in a range of 0.025-0.18, thereby dividing magnetic domains in the amorphous alloy while suppressing increase in the apparent power.

The amorphous alloy ribbon is preferably irradiated with the laser beam pulses passing through a galvanometer scanner or a polygon scanner and an fθ lens.

The laser beam pulses are preferably generated by a fiber laser. Because the fiber laser capable of highly focusing to a small spot is resistant to thermal influence, it can suppress the formation of molten alloy splashes around the recesses, thereby forming doughnut-shaped projections having smooth surfaces. Also, because of a large depth of focus, high-precision depth control can be conducted by the fiber laser, thereby forming shallow recesses on thin alloy ribbons.

To obtain a t/T ratio of 0.2 or less, it is preferable to adjust the depth of focus of the fθ lens, or to control the irradiation energy density of laser beams per one pulse.

The irradiation energy density of the laser beam pulses is preferably 5 J/cm$^2$ or less, preferably 2-5 J/cm$^2$ more, most preferably 2.5-4 J/cm$^2$.

The magnetic core of the present invention is obtained by laminating or winding the above soft-magnetic, amorphous alloy ribbon. This magnetic core has low iron loss and a high lamination factor.

The soft-magnetic, amorphous alloy ribbon is preferably provided with the above recesses, and then heat-treated in a magnetic field oriented in a magnetic path direction. This reduces core loss at low frequencies, and apparent power contributing to the generation of sound noise.

BRIEF DESCRIPTION OF THE DRAWINGS

FIG. 2(*b*) is a schematic plan view showing recesses and annular projections formed on a soft-magnetic, amorphous alloy ribbon.

FIG. 4(*b*) is an enlarged electron photomicrograph (magnification: 240 times) showing one of the recesses shown in FIG. 4(*a*).

DESCRIPTION OF THE PREFERRED EMBODIMENTS

[1] Amorphous Alloy Ribbon

Figure 1:
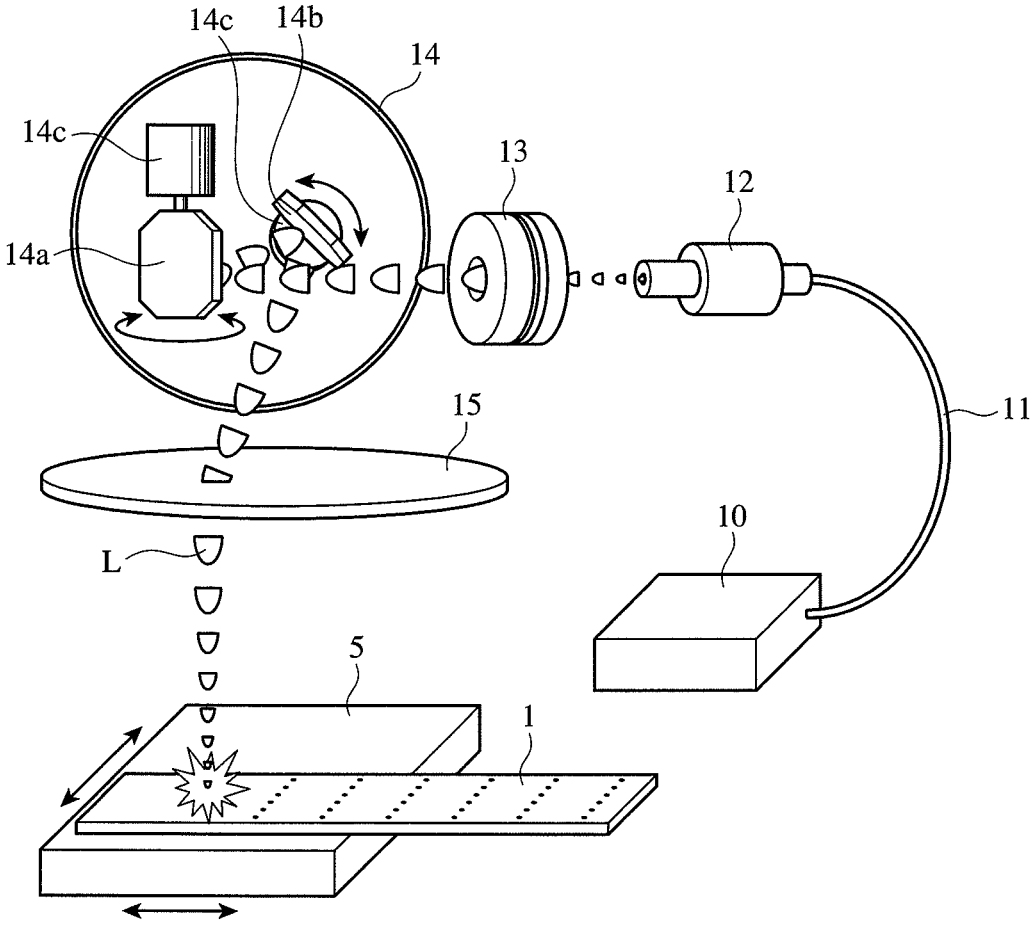
FIG. 1 is a schematic view showing one example of laser-beam-radiating apparatuses used in the production method of the present invention.

Amorphous alloys usable in the present invention include Fe—B alloys, Fe—Si—B alloys, Fe—Si—B—C alloys, Fe—Si—B—P alloys, Fe—Si—B—C—P alloys, Fe—P—B alloys, etc., and alloys based on Fe, Si and B are preferable because they are resistant to embrittlement by laser beam irradiation, and easily subject to working such as cutting, etc. The amorphous Fe—Si—B alloy preferably has a composition comprising 1-15 atomic % of Si and 8-20 atomic % of B, the balance being substantially Fe and inevitable impurities. The Fe—Si—B—C alloy preferably has a composition comprising 1-15 atomic % of Si, 8-20 atomic % of B, and 3 atomic % or less of C, the balance being Fe and inevitable impurities. In any alloys, the inclusion of 10 atomic % or less of Si and 17 atomic % or less of B provides high Bs, and drastically reduces iron loss due to the irradiation of laser beams, making the production of amorphous alloys easy. In addition to the above components, the amorphous alloy may contain at least one selected from the group consisting of Co, Ni, Mn, Cr, V, Mo, Nb, Ta, Hf, Zr, Ti, Cu, Au, Ag, Sn, Ge, Re, Ru, Zn, In and Ga, in a proportion of 5 atomic % or less in total to Fe. The inevitable impurities are S, O, N, Al, etc.

Amorphous alloy ribbons are produced preferably by a liquid quenching method, such as a single roll method or a double roll method. To improve the efficiency of laser beam irradiation, the amorphous alloy ribbon, which are irradiated with laser beams, preferably has a surface having reflectance R (%) of 15-80% at a wavelength $\lambda$ of 1000 nm. The reflectance R (%) is expressed by $100\times\Phi r/\Phi$, wherein $\Phi$ represents the quantity of luminous flux vertically projected to the ribbon surface, and $\Phi r$ represents the quantity of luminous flux reflected from the ribbon surface in the incident direction. $\Phi$ and $\Phi r$ are measured by a spectrometer (JASCO V-570 available from JASCO Corporation) at a wavelength of 1000 nm (close to the wavelength of laser beams used).

The thickness T of the amorphous alloy ribbon is preferably 30 μm or less as described below. The width of the amorphous alloy ribbon is not restrictive, and an amorphous alloy ribbon as wide as about 25-220 mm can be subject to uniform laser scribing by a fiber laser described below.

To suppress iron loss, one or both surfaces of the amorphous alloy ribbon may be coated with an insulating layer of $SiO_2$, $Al_2O_3$, MgO, etc. The formation of an insulating layer on a surface not subjected to laser scribing can suppress the deterioration of magnetic properties. Even a laser-scribed surface can be provided with an insulating layer without difficulty, because of low doughnut-shaped projections.

[2] Laser Scribing

To divide magnetic domains in an amorphous alloy ribbon produced by a rapid quenching method, its surface is scanned with laser beam pulses in a transverse direction with predetermined longitudinal intervals. As an apparatus for generating laser beam pulses, a YAG laser, a $CO_2$ gas laser, a fiber laser, etc. may be used. Preferable among them is a fiber laser capable of stably generating high-power, high-frequency laser beam pulses for a long period of time. In the fiber laser, laser beams introduced into a fiber are oscillated by diffraction gratings on both ends thereof by the principle of fiber Bragg grating (FBG). Because laser beams are excited in an elongated fiber, they are not subject to a thermal lens effect leading to their quality deterioration due to a temperature gradient occurring in the crystals. Further, because a fiber core is as thin as several microns, even high-power laser beams are conveyed in a single mode with a reduced beam diameter, resulting in high-energy-density laser beams. In addition, because of a large depth of focus, lines of recesses can be formed precisely on a ribbon as wide as 200 mm or more. The pulse width of the fiber laser is usually from about microseconds to about picoseconds, though it may be on the femtosecond level. The laser beams have wavelength of about 250-1100 nm, and they are mostly used in a wavelength of about 1000 nm. The beam diameter of the laser beams is preferably 10-300 μm, more preferably 20-100 μm, most preferably 30-90 μm.

FIG. 1 shows one example of laser-beam-radiating apparatuses. This apparatus comprises a laser oscillator (fiber laser) 10, a collimator 12, a beam expander 13, a galvanometer scanner 14, and a fθ lens 15. Laser beam pulses L (for example, wavelength: 1065 μm) generated by the laser oscillator 10 are transmitted via the fiber 11 to the collimator 12, in which they are made parallel. The diameters of parallel laser beams L are expanded by the beam expander 13. After passing through the galvanometer scanner 14, they are collected by the fθ lens 15, and irradiated onto the amorphous alloy ribbon 1 placed on a table 5 movable in both X and Y directions. The galvanometer scanner 14 has mirrors 14*a*, 14*b* turning around the X and Y axes, each mirror 14*a*, 14*b* being moved by a motor 14*c*. With a combination of the mirrors 14*a*, 14*b*, the ribbon 1 is scanned with laser beam pulses L in a transverse direction with predetermined longitudinal intervals. In place of the galvanometer scanner 14, a polygon scanner (not shown) comprising a polygon mirror at a tip of the motor may be used. Of course, when lines of recesses are continuously formed on the amorphous alloy ribbon 1 in a transverse direction with predetermined longitudinal intervals, the amorphous alloy ribbon 1 is moved in a longitudinal direction. Accordingly, the scanning direction of laser beams L should be inclined to the transverse direction with a predetermined angle.

The irradiation of laser beams is preferably conducted while the amorphous alloy ribbon unwound from a reel is moving intermittently in a longitudinal direction, though it may be conducted before an amorphous alloy ribbon produced by a rapid quenching method is wound around a reel.

Taking into consideration the embrittlement and stress removal of a magnetic core by a heat treatment, the laser scribing is conducted preferably before the heat treatment. Because recesses formed on a soft-magnetic, amorphous alloy ribbon by the irradiation of laser beams are not crystallized, the ribbon has such good workability that it is easily cut and bent to produce magnetic cores.

[3] Recesses

Figure 2A:
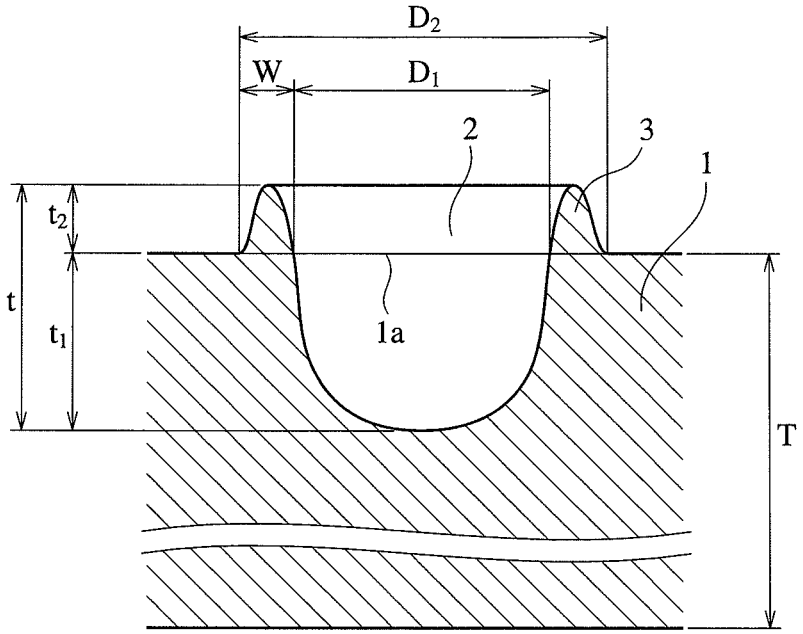
FIG. 2(*a*) is a schematic cross-sectional view showing recesses and annular projections formed on a soft-magnetic, amorphous alloy ribbon.
Figure 2B:
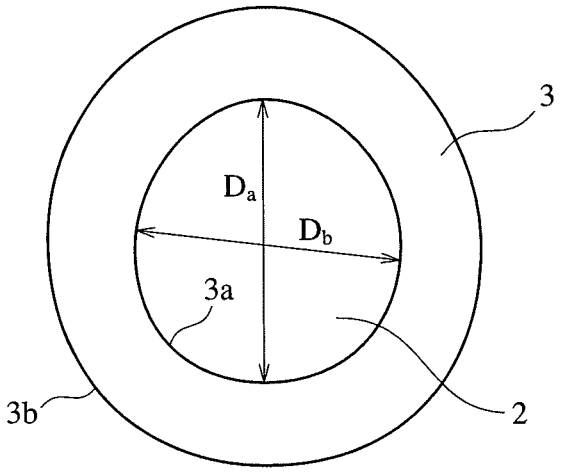

FIG. 2(*a*) schematically shows the cross section of a substantially circular recess 2 and a surrounding annular projection (rim) 3 formed on the soft-magnetic, amorphous alloy ribbon 1. The term "substantially circular" used herein means, as shown in FIG. 2(*b*), that the contour of each recess 2 needs not to be a true circle, but may be a deformed circle or an ellipse. A ratio of a major axis Da to a minor axis Db, which represents the degree of deformation of the deformed circle or the ellipse, is preferably within 1.5.

As shown in FIG. 2(*a*), the diameter $D_1$ of the recess 2 is a diameter of the opening of the recess 2 at a level of a straight line 1*a* passing the surface of the ribbon 1, the depth $t_1$ of the recess 2 is a distance between the straight line 1*a* and the bottom of the recess 2, the outer diameter $D_2$ of the annular projection 3 is an outer diameter of the annular projection 3 at a level of the straight line 1*a*, the height $t_2$ of the annular projection 3 is a distance between the straight line 1*a* and the apex of the annular projection 3, and the width W of the annular projection 3 is $[(D_2-D_1)/2]$ determined at a level of the straight line 1*a*. Any of these parameters are expressed by average values determined from recesses 2 and annular projections 3 in plural (3 or more) transverse lines of recesses.

Because the amorphous alloy ribbon 1 is rapidly solidified without crystallization after melting by the irradiation of laser beams, the resultant recesses 2 and surrounding annular projections 3 are substantially in an amorphous state. Because this rapid solidification generates stress near the recesses 2, forming magnetic domains whose magnetization is oriented in the depth direction of the ribbon, it is presumed that the apparent power increases. Stress increases not only by the height of the annular projections 3, but also by melt splashes attached around the recesses 2. On the other hand, the division of magnetic domains by the recesses 2 reduces iron loss, resulting in reduced apparent power.

Figure 5:
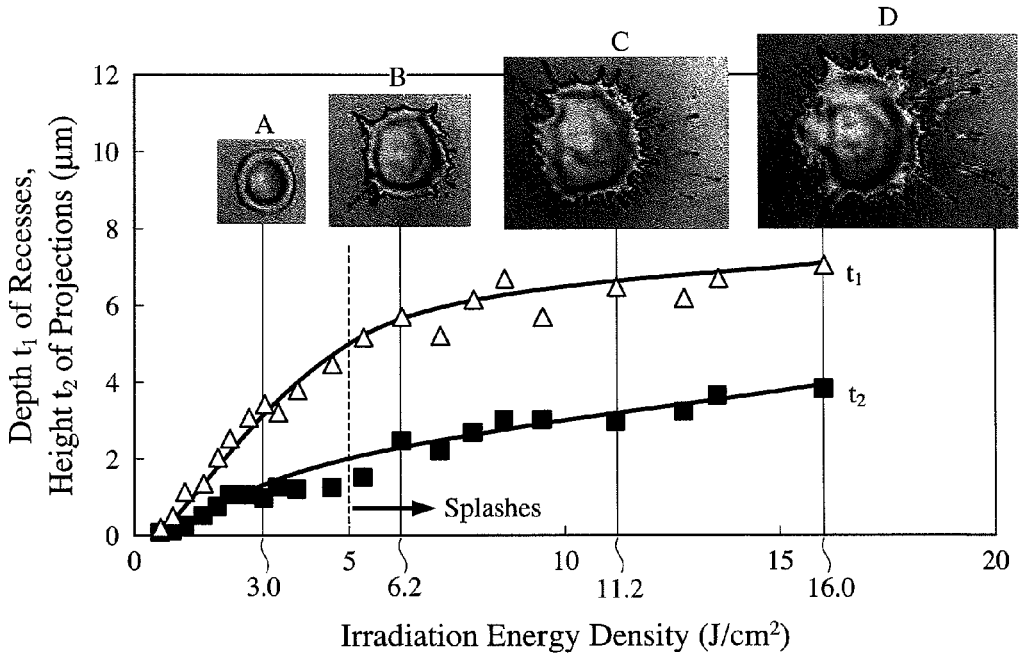
FIG. 5 is a graph showing the relation between the depth $t_1$ of recesses and the height $t_2$ of annular projections and the irradiation energy density of laser beams, together with electron photomicrographs of recesses and annular projections formed on the soft-magnetic, amorphous alloy ribbon.

In the present invention, annular projections having a doughnut shape (simply called "doughnut-shaped projections") having smooth surfaces substantially free from molten alloy splashes, with height $t_2$ limited to 2 μm or less, are formed around the recesses by controlling the irradiation energy of laser beams to the thickness T of the amorphous alloy ribbon. The term "smooth surfaces substantially free from splashes" used herein means, as shown in FIG. 2(*b*), that annular projections 3 observed in an optical photomicrograph (50 times) have smooth inside and outside contours 3*a*, 3*b* without projections, with the same surface roughness between the annular projections 3 and other portions of the amorphous alloy ribbon 1. The "doughnut shape" has smooth surface and contour, unless otherwise mentioned. Accordingly, for example, when the inside and outside contours of annular projections 3 are ragged in recesses B, C, D as shown in FIG. 5, the requirement of "smooth surfaces substantially free from splashes" is not met. By the above requirement, it is possible to reduce the iron loss while effectively suppressing increase in the apparent power. The height $t_2$ of the doughnut-shaped projections 3 is more preferably 1.8 μm or less, most preferably 0.3-1.8 μm.

It has been found, however, that even though the doughnut-shaped projections 3 have smooth surfaces substantially free from splashes with their height $t_2$ of 2 μm or less, a sufficient loss-reducing effect would not be obtained if the depth $t_1$ of the recesses 2 were insufficient relative to the thickness T of the amorphous alloy ribbon. Specifically, when $t_1/T$ is less than 0.025, the iron loss is not substantially reduced by the laser scribing. Oppositely, when the depth $t_1$ of the recesses 2 is too large relative to the thickness T of the ribbon 1, the apparent power drastically increases. Specifically, when $t_1/T$ is more than 0.18, the apparent power drastically increases. Accordingly, $t_1/T$ should be in a range of 0.025-0.18, preferably 0.03-0.15, more preferably 0.03-0.13. To reduce the iron loss by the laser scribing while suppressing increase in the apparent power, the thickness T of the amorphous alloy ribbon 1 is preferably 30 μm or less. When the thickness T of the amorphous alloy ribbon 1 is more than 30 μm, the value of $t_1$ is large for the same $t_1/T$, resulting in larger apparent power.

A ratio t/T of the total t $(=t_1+t_2)$ of the depth $t_1$ of the recesses 2 and the height $t_2$ of the doughnut-shaped projections 3 to the thickness T of the ribbon 1 is also related to the suppression of increase in the apparent power. When t/T is 0.2 or less, increase in the apparent power is suppressed. The ratio t/T is preferably 0.18 or less, more preferably 0.16 or less.

When the height $t_2$ of the doughnut-shaped projections is 2 μm or less, magnetic cores obtained by laminating or winding soft-magnetic, amorphous alloy ribbons have as high lamination factors LF as 89% or more. When $t_2$ exceeds 2 μm, LF drastically decreases, and the apparent power S increases.

To obtain low iron loss and low apparent power, the diameter $D_1$ of the recesses 2 is preferably 20-50 μm, more preferably 20-40 μm, most preferably 24-38 μm. When the diameter $D_1$ of the recesses 2 is too large, the apparent power tends to increase under the influence of stress and splashes. The outer diameter $D_2$ of the doughnut-shaped projections 3 is preferably 100 μm or less, more preferably 80 μm or less, most preferably 76 μm or less. To reduce the iron loss sufficiently, the lower limit of the outer diameter $D_2$ is preferably 30 μm.

The longitudinal intervals of lines of recesses is generally 2-20 mm, for example, preferably 3-10 mm. In the transverse lines of recesses, recesses may be arranged with intervals, or adjacent recesses may be overlapped. In general, the number density of recesses in the transverse lines is 2/mm to 25/mm, preferably 4/mm to 20/mm.

[4] Magnetic Cores

Magnetic cores obtained by laminating or winding the soft-magnetic, amorphous alloy ribbons of the present invention have low iron loss with suppressed apparent power and high lamination factors LF. A heat treatment in a magnetic field oriented in a magnetic path direction of the formed magnetic core can reduce a core loss (hysteresis loss) and apparent power, resulting in reduced sound noise.

The present invention will be explained in more detail referring to Examples below without intention of restriction.

Example 1

Figure 3:
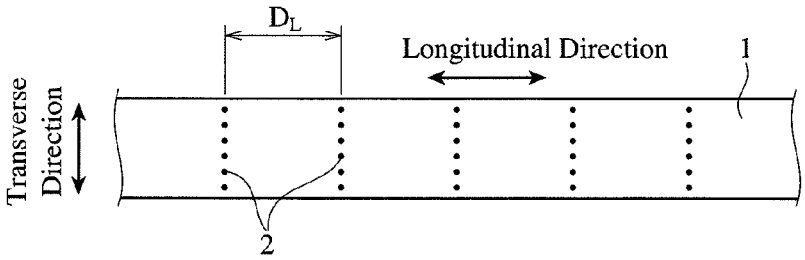
FIG. 3 is a schematic plan view showing the arrangement of recesses formed on a soft-magnetic, amorphous alloy ribbon.

An amorphous alloy ribbon as wide as 5 mm and as thick as 23 μm having a composition comprising 11.5 atomic % of B, and 8.5 atomic % of Si, the balance being Fe and inevitable impurities, was produced by a single roll method in the air. A freely solidified surface of this alloy ribbon had reflectance R of 68.3% to light having a wavelength of 1000 nm. As shown in FIG. 1, the freely solidified surface of this amorphous alloy ribbon was scanned with laser beam pulses having a wavelength of 1065 nm, a pulse width of 550 ns and a beam diameter of 90 μm at an irradiation energy density of 2.5 J/cm$^2$, which were sent from the fiber laser 10 via the galvanometer scanner (mirror) 14, to form transverse lines of recesses as shown in FIG. 3. The number density of recesses in transverse lines was 2/mm, and the longitudinal intervals $D_L$ of the lines of recesses were 5 mm. The sizes of the recesses and annular projections surrounding them were as follows:

Recesses
Diameter $D_1$: 50 μm,
Depth $t_1$: 1.2 μm,
Annular Projections
Shape: Doughnut shape having smooth surface and contour,
Outer diameter $D_2$: 80 μm,
Height $t_2$: 0.4 μm,
Width W: 15 μm, and
$t(=t_1+t_2)/T$: 0.07.

Figure 4A:
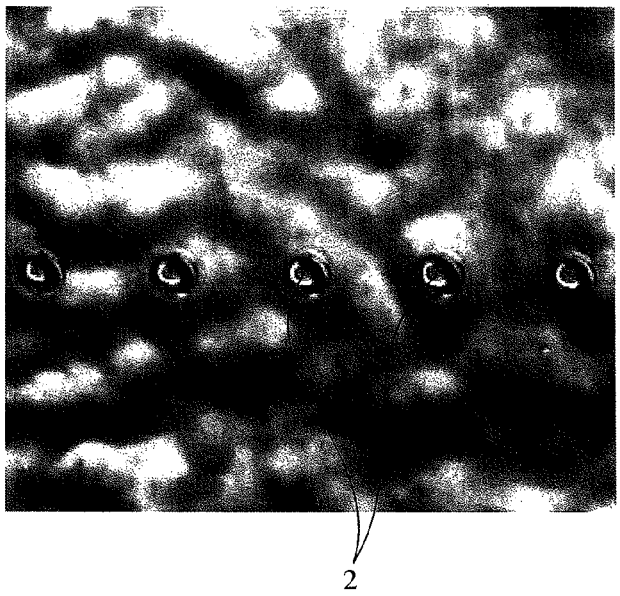
FIG. 4(*a*) is an electron photomicrograph (magnification: 60 times) showing one example of recess lines formed on a soft-magnetic, amorphous alloy ribbon.
Figure 4B:
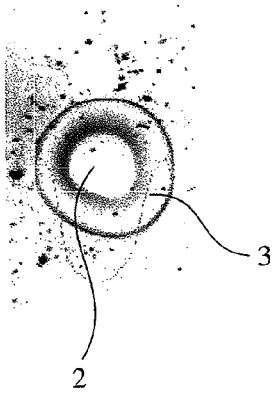

FIGS. 4(*a*) and 4(*b*) show the electron photomicrographs of recesses and annular projections surrounding them. As is clear from FIGS. 4(*a*) and 4(*b*), the annular projections in a doughnut shape had smooth surfaces substantially free from splashes of the alloy melted by the irradiation of laser beams. Transmission electron microscopic observation revealed that there were no crystal phases in the recesses and the doughnut-shaped projections. This confirms that the recesses and the doughnut-shaped projections were constituted by an amorphous phase.

Example 2

Figure 6:
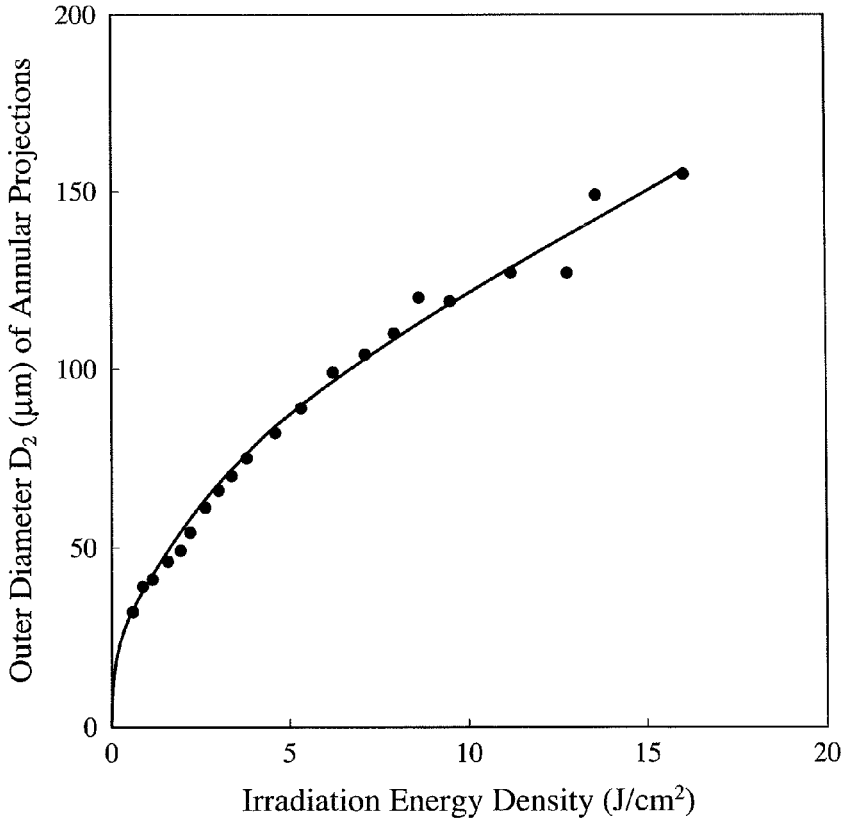
FIG. 6 is a graph showing the relation between the outer diameter $D_2$ of annular projections on the soft-magnetic, amorphous alloy ribbon and the irradiation energy density of laser beams.

With the irradiation energy density of laser beams having a wavelength of 1065 nm, a pulse width of 500 ns and a beam diameter of 60 μm changed, lines of recesses having various annular projection heights and recess depths were produced on the same amorphous alloy ribbon as in Example 1. FIG. 5 shows the relation between the irradiation energy density of laser beams and the height $t_2$ of annular projections, and FIG. 6 shows the relation between the irradiation energy density of the same laser beams and the outer diameter $D_2$ of the annular projections. As the irradiation energy density increased, the recesses 2 became deeper, and the annular projections 3 had larger outer diameters $D_2$ and height with more molten alloy splashes. When the irradiation energy density was 5 J/cm$^2$ or less, the annular projections 3 in a doughnut shape had heights $t_2$ of 2 μm or less and outer diameters $D_2$ of 90 μm or less. Of course, the heights $t_2$ and outer diameters $D_2$ of the doughnut-shaped projections change depending not only on laser beams but also on irradiation conditions such as pulse width, etc.

Example 3

Figure 7:
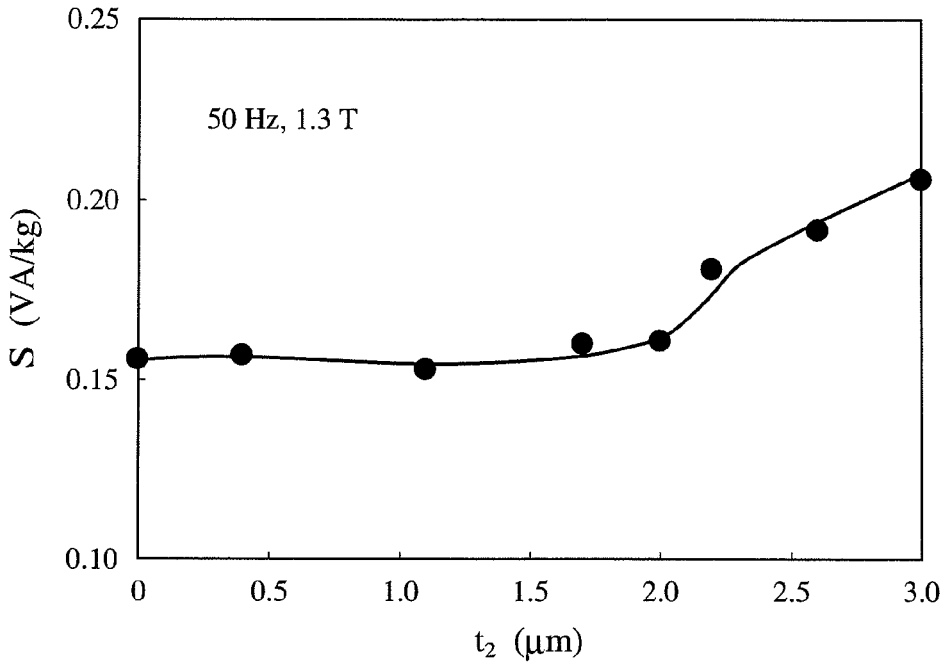
FIG. 7 is a graph showing the relation between the apparent power S of a soft-magnetic, amorphous alloy ribbon at 50 Hz and 1.3 T and the height $t_2$ of annular projections.
Figure 8:
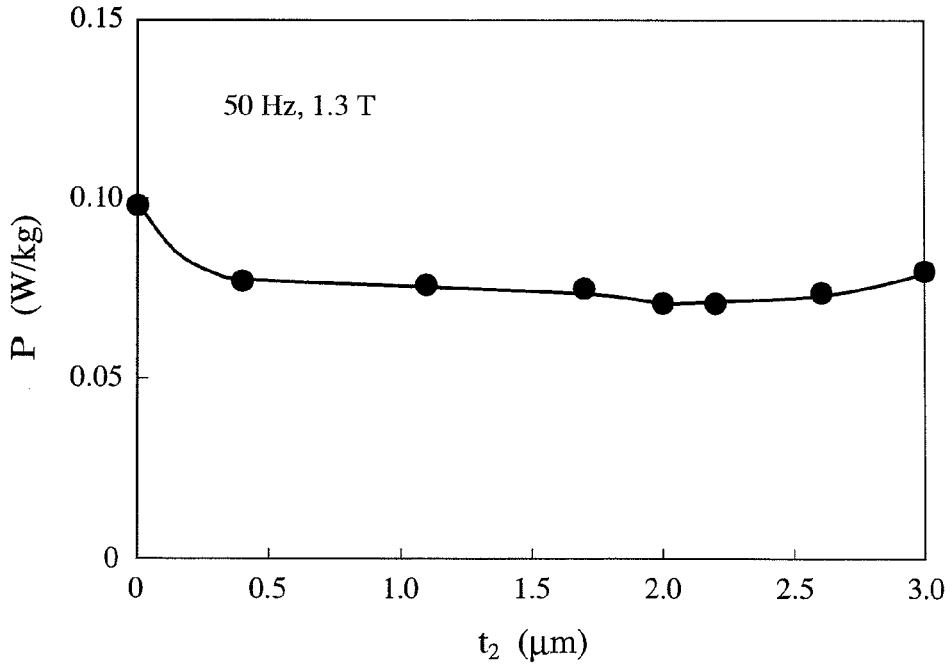
FIG. 8 is a graph showing the relation between the iron loss P of a soft-magnetic, amorphous alloy ribbon at 50 Hz and 1.3 T and the height $t_2$ of annular projections.

Some of the ribbons provided with recesses in Example 2 were cut to 120 mm, and heat-treated at 350° C. for 1 hour in a magnetic field of 1.2 kA/m oriented in the longitudinal direction of the ribbon. The resultant single-plate samples were measured with respect to iron loss P (W/kg) and apparent power S (VA/kg). FIG. 7 shows the relation between the height $t_2$ of annular projections and the apparent power S at 50 Hz and 1.3 T. As is clear from FIG. 7, $t_2$ of 2 μm or less provided a low apparent power S, but when $t_2$ exceeded 2 μm, the apparent power S increased drastically. FIG. 8 shows the relation between the height $t_2$ of annular projections and the iron loss P at 50 Hz and 1.3 T. As is clear from FIG. 8, the formation of recesses decreased the iron loss P, but $t_2$ of more than 2 μm provided slightly increased iron loss P. As is clear from FIGS. 7 and 8, with the height $t_2$ of annular projections in a range of about 2.5 μm or less (particularly in a range of 0.5-2.5 μm), the iron loss P tends to decrease as $t_2$ increases (as the irradiation energy density of laser beams increases). Though the apparent power S is substantially constant at $t_2$ of 2 μm or less, it tends to increase drastically when $t_2$ exceeds 2 μm. Accordingly, to meet both requirements of low iron loss and low apparent power, the height $t_2$ of annular projections should be 2 μm or less, particularly in a range of 0.5-2 μm.

Example 4

5-mm-wide, amorphous alloy ribbons having various thicknesses were produced from alloy melts having the compositions shown in Table 1 by a single roll method. The thickness T of each amorphous alloy ribbon, and the reflectance R of a freely solidified surface of each amorphous alloy ribbon to light having a wavelength of 1000 nm are shown in Table 1. As shown in FIG. 1, laser beam pulses having a wavelength of 1065 nm, a pulse width of 500 ns and a beam diameter of 60 μm were supplied from a fiber laser 10 via a galvanometer scanner (mirror) 14, to scan a freely solidified surface of each amorphous alloy ribbon with an irradiation energy density of 5 J/cm$^2$ or less, thereby forming transverse lines of recesses with longitudinal intervals of 5 mm. The number density of recesses in the lines was 4/mm. With respect to each amorphous alloy ribbon provided with recesses, the diameter $D_1$ and depth $t_1$ of the recesses, and the outer diameter $D_2$, height $t_2$ and width W of the annular projections were measured on plural lines of recesses, and averaged.

Each alloy ribbon provided with recesses was cut to 120 mm, and heat-treated at 330-370° C. for 1 hour in a magnetic field of 1.6 kA/m oriented in the longitudinal direction of the ribbon, to provide a single-plate sample, whose iron loss P (W/kg) and apparent power S (VA/kg) were measured at 50 Hz and 1.3 T. Also, 20 amorphous alloy ribbon pieces provided with recesses were laminated to measure a lamination factor LF. These measurement results are shown in Table 1.

TABLE 1

| Sample No. | Composition (atomic %) | Thickness T (μm) | Recesses $D_1$ (μm) | Recesses $t_1$ (μm) |
|---|---|---|---|---|
| 1 | $Fe_{bal.}B_{13}Si_9$ | 25 | 26 | 0.95 |
| 2 | $Fe_{bal.}B_{12}Si_{10}$ | 24 | 26 | 1.18 |
| 3 | $Fe_{bal.}B_{11}Si_9$ | 24 | 27 | 1.04 |
| 4 | $Fe_{bal.}B_{14}Si_4$ | 23 | 30 | 3.00 |
| 5 | $Fe_{bal.}B_{15}Si_4$ | 28 | 29 | 2.64 |
| 6 | $Fe_{bal.}B_{16}Si_3$ | 30 | 36 | 3.10 |
| 7 | $Fe_{bal.}B_{16}Si_2$ | 30 | 37 | 3.40 |
| 8 | $Fe_{bal.}B_{15}Si_3$ | 30 | 37 | 3.10 |
| 9 | $Fe_{bal.}B_{15}Si_3C_1$ | 29 | 30 | 2.96 |
| 10 | $Fe_{bal.}B_{16}Si_2C_1$ | 29 | 25 | 2.58 |
| 11 | $Fe_{bal.}B_{15}Si_{3.5}C_{0.5}$ | 25 | 24 | 2.45 |
| 12 | $Fe_{bal.}B_{15}Si_{2.5}C_{0.5}$ | 24 | 25 | 2.84 |
| 13 | $Fe_{bal.}B_{15.5}Si_2C_{0.5}$ | 28 | 32 | 3.00 |
| 14 | $Fe_{bal.}B_{15.5}Si_2C_{0.5}P_1$ | 29 | 26 | 1.43 |
| 15 | $Fe_{bal.}B_{15}Si_3P_2$ | 27 | 27 | 0.95 |
| 16 | $Fe_{bal.}B_{15.5}Si_3C_{0.5}P_{0.5}$ | 26 | 28 | 0.90 |
| 17 | $Fe_{bal.}B_{15}Si_{3.5}C_{0.3}Mo_{0.5}Nb_{0.5}$ | 32 | 29 | 2.62 |
| 18 | $Fe_{bal.}B_{15}Si_{3.5}C_{0.3}Mn_{0.13}V_{0.1}$ | 31 | 29 | 2.93 |
| 19 | $Fe_{bal.}B_{15}Si_{3.5}C_{0.3}Mn_{0.1}S_{0.05}$ | 29 | 27 | 2.77 |
| 20 | $Fe_{bal.}B_{15}Si_{3.5}C_{0.3}Mn_{0.12}Cu_{0.1}$ | 35 | 35 | 3.00 |
| 21 | $Fe_{bal.}B_{15}Si_{3.5}C_{0.3}Mn_{0.12}Cr_{0.2}$ | 36 | 38 | 3.18 |
| 22 | $Fe_{bal.}B_{15}Si_{3.5}C_{0.3}Mn_{0.12}Co_{0.2}$ | 35 | 36 | 2.90 |
| 23 | $Fe_{bal.}B_{15}Si_{3.5}C_{0.3}Mn_{0.12}Ni_{0.2}$ | 41 | 26 | 2.07 |

TABLE 1-continued

| | | | | |
|---|---|---|---|---|
| 24 | $Fe_{bal.}B_{15}Si_{3.5}C_{0.3}Mn_{0.12}Sn_{0.2}$ | 40 | 24 | 1.50 |
| 25* | $Fe_{bal.}B_{13}Si_{9}$ | 40 | 20 | 0.80 |
| 26* | $Fe_{bal.}B_{12}Si_{10}$ | 24 | 48 | 4.32 |
| 27* | $Fe_{bal.}B_{11}Si_{9}$ | 24 | 71 | 5.40 |
| 28* | $Fe_{bal.}B_{15}Si_{3.5}C_{0.5}$ | 25 | 110 | 6.00 |
| 29* | $Fe_{bal.}B_{15}Si_{3.5}C_{0.3}Mn_{0.12}Co_{0.2}$ | 35 | 152 | 10.20 |
| 30* | $Fe_{bal.}B_{15.5}Si_{3}C_{0.5}P_{0.5}$ | 26 | 59 | 4.42 |
| 31* | $Fe_{bal.}B_{15}Si_{3.5}C_{0.3}Mn_{0.12}Sn_{0.2}$ | 40 | 186 | 12.50 |

| Sample No. | Annular Projections Shape | $D_2$ (μm) | $t_2$ (μm) | W (μm) | $t_1/T$ | $t/T^{(1)}$ |
|---|---|---|---|---|---|---|
| 1 | Doughnut-Shaped | 40 | 0.3 | 7 | 0.038 | 0.05 |
| 2 | Doughnut-Shaped | 46 | 0.5 | 10 | 0.049 | 0.07 |
| 3 | Doughnut-Shaped | 43 | 0.4 | 8 | 0.043 | 0.06 |
| 4 | Doughnut-Shaped | 60 | 1.1 | 15 | 0.130 | 0.18 |
| 5 | Doughnut-Shaped | 59 | 1.0 | 15 | 0.094 | 0.13 |
| 6 | Doughnut-Shaped | 70 | 1.7 | 17 | 0.103 | 0.16 |
| 7 | Doughnut-Shaped | 73 | 2.0 | 18 | 0.113 | 0.18 |
| 8 | Doughnut-Shaped | 71 | 1.7 | 17 | 0.103 | 0.16 |
| 9 | Doughnut-Shaped | 60 | 1.1 | 15 | 0.102 | 0.14 |
| 10 | Doughnut-Shaped | 53 | 0.9 | 14 | 0.089 | 0.12 |
| 11 | Doughnut-Shaped | 52 | 0.8 | 14 | 0.098 | 0.13 |
| 12 | Doughnut-Shaped | 55 | 1.0 | 15 | 0.118 | 0.16 |
| 13 | Doughnut-Shaped | 62 | 1.2 | 15 | 0.107 | 0.15 |
| 14 | Doughnut-Shaped | 48 | 0.6 | 11 | 0.049 | 0.07 |
| 15 | Doughnut-Shaped | 41 | 0.4 | 7 | 0.035 | 0.05 |
| 16 | Doughnut-Shaped | 42 | 0.4 | 7 | 0.035 | 0.05 |
| 17 | Doughnut-Shaped | 51 | 0.9 | 11 | 0.082 | 0.11 |
| 18 | Doughnut-Shaped | 59 | 1.1 | 15 | 0.095 | 0.13 |
| 19 | Doughnut-Shaped | 57 | 1.0 | 15 | 0.096 | 0.13 |
| 20 | Doughnut-Shaped | 65 | 1.2 | 15 | 0.086 | 0.12 |
| 21 | Doughnut-Shaped | 76 | 1.5 | 19 | 0.088 | 0.13 |
| 22 | Doughnut-Shaped | 70 | 1.3 | 17 | 0.083 | 0.12 |
| 23 | Doughnut-Shaped | 52 | 0.8 | 13 | 0.055 | 0.07 |
| 24 | Doughnut-Shaped | 48 | 0.5 | 12 | 0.038 | 0.05 |
| 25* | Doughnut-Shaped | 32 | 0.3 | 6 | 0.020 | 0.03 |
| 26* | Doughnut-Shaped | 82 | 2.4 | 17 | 0.180 | 0.28 |
| 27* | Doughnut-Shaped | 103 | 3.0 | 16 | 0.225 | 0.35 |
| 28* | Crown-Shaped(2) | 136 | 3.5 | 13 | 0.240 | 0.38 |
| 29* | Crown-Shaped(2) | 180 | 3.8 | 14 | 0.291 | 0.40 |
| 30* | Doughnut-Shaped | 91 | 2.6 | 16 | 0.170 | 0.27 |
| 31* | Crown-Shaped(2) | 210 | 4.1 | 12 | 0.313 | 0.41 |

| Sample No. | Reflectance R (%) | Iron Loss P (W/kg) | Apparent Power S (VA/kg) | Lamination Factor LF (%) |
|---|---|---|---|---|
| 1 | 63 | 0.09 | 0.14 | 90 |
| 2 | 65 | 0.08 | 0.14 | 90 |
| 3 | 62 | 0.08 | 0.14 | 90 |
| 4 | 62 | 0.06 | 0.15 | 90 |
| 5 | 59 | 0.06 | 0.15 | 89 |
| 6 | 71 | 0.06 | 0.16 | 90 |
| 7 | 70 | 0.08 | 0.17 | 90 |
| 8 | 69 | 0.07 | 0.16 | 91 |
| 9 | 68 | 0.06 | 0.15 | 90 |
| 10 | 67 | 0.07 | 0.15 | 90 |
| 11 | 70 | 0.06 | 0.15 | 90 |
| 12 | 71 | 0.07 | 0.15 | 89 |
| 13 | 64 | 0.07 | 0.15 | 90 |
| 14 | 62 | 0.06 | 0.14 | 90 |
| 15 | 62 | 0.08 | 0.14 | 91 |
| 16 | 63 | 0.07 | 0.14 | 91 |
| 17 | 55 | 0.07 | 0.15 | 90 |
| 18 | 62 | 0.07 | 0.16 | 90 |
| 19 | 60 | 0.08 | 0.16 | 89 |
| 20 | 70 | 0.07 | 0.16 | 91 |
| 21 | 28 | 0.07 | 0.16 | 90 |
| 22 | 23 | 0.08 | 0.16 | 91 |
| 23 | 15 | 0.09 | 0.14 | 91 |
| 24 | 74 | 0.09 | 0.14 | 91 |
| 25* | 70 | 0.10 | 0.13 | 93 |
| 26* | 65 | 0.10 | 0.20 | 87 |
| 27* | 62 | 0.11 | 0.22 | 86 |
| 28* | 70 | 0.12 | 0.25 | 85 |
| 29* | 59 | 0.13 | 0.29 | 85 |
| 30* | 83 | 0.10 | 0.20 | 86 |
| 31* | 13 | 0.12 | 0.31 | 84 |

Note:
*Outside the scope of the present invention.
(1) $t = t_1 + t_2$.
(2) The term "crown-shaped" means that the annular projections were provided with molten alloy splashes.

As is clear from Table 1, when a ratio $t_1/T$ of the depth $t_1$ of recesses to the thickness T of the ribbon was in a range of 0.025-0.18, annular projections formed around the recesses were in a doughnut shape having smooth surfaces substantially free from alloy splashes, the height $t_2$ of the annular projections was 2 μm or less, and the diameter $D_1$ of the recesses was 50 μm or less, particularly 40 μm or less. When the height $t_2$ of the doughnut-shaped projections was 2 μm or less, particularly 0.3-1.8 μm, low iron loss was achieved substantially without increase in the apparent power S.

When the amorphous alloy ribbon was as thick as 40 μm, with the recess depth $t_1$ as small as 0.8 μm, $t_1/T$ was 0.02 (smaller than the lower limit of 0.025), failing to sufficiently reduce the iron loss P (Sample 25). In Samples 23 and 24, a ratio $t_1/T$ of the depth $t_1$ of recesses to the thickness T of the amorphous alloy ribbon was 0.055 and 0.038, respectively, resulting in as relatively high iron loss P as 0.09 W/kg. This means that the reduction of iron loss P tends to be insufficient even if $t_1/T$ is in a range of 0.025-0.18, when the thickness T of the amorphous alloy ribbon is more than 30 μm, particularly more than 35 μm.

The data in Table 1 has revealed that soft-magnetic, amorphous alloy ribbons meeting the conditions of the present invention have low iron loss P and low apparent power S as well as high lamination factors LF, providing low-sound-noise, low-iron-loss, small magnetic cores.

Example 5

Comparative Example 1

An amorphous alloy ribbon as wide as 170 mm and as thick as 25 μm having a composition comprising 15.5 atomic % of B, and 3.5 atomic % of Si, the balance being Fe and inevitable impurities, was produced by a single roll method in the air. The freely solidified surface of this alloy ribbon had reflectance R of 69.5% to light having a wavelength of 1000 mm. As shown in FIG. 1, laser beam pulses having a wavelength of 1065 nm, a pulse width of 550 ns and a beam diameter of 90 μm were supplied from a fiber laser via a galvanometer scanner (mirror), to scan the freely solidified surface of this amorphous alloy ribbon with an irradiation energy density of 2.5 $J/cm^2$ in a transverse direction, thereby forming transverse lines of recesses with longitudinal intervals of 5 mm as shown in FIG. 3. The number density of recesses in the lines was 2/mm. The depth $t_1$ of the recesses was 1.2 μm, the height $t_2$ of doughnut-shaped projections was 0.5 μm, t/T was 0.07, and the lamination factor LF was 89%. This alloy ribbon was cut to pieces as long as 120 mm, and 20 pieces were laminated to produce a magnetic core. This magnetic core was heat-treated at 330° C. for 1 hour in a magnetic field of 1.2 kA/m oriented in the longitudinal direction of the ribbon. A coil was wound around this magnetic core, and excited to 1.4 T at 50 Hz to measure sound noise.

As Comparative Example 1, a freely solidified surface of the same amorphous alloy ribbon as in Example 5 was scanned with laser beam pulses having a wavelength of 1065 nm, a pulse width of 550 ns and a beam diameter of 90 μm with an irradiation energy density of 6.6 J/cm$^2$, to form lines of recesses. The depth $t_1$ of the recesses was 5.5 μm, the height $t_2$ of annular projections was 2.8 μm, t/T was 0.33, and the lamination factor LF was 86%. A magnetic core was produced from this alloy ribbon by the same method as in Example 5, and a coil was wound around it and excited to 1.4 T at 50 Hz to measure sound noise. As a result, the magnetic core noise was 53 dB in Example 5 and 63 dB in Comparative Example 1. It was thus confirmed that the magnetic core of the present invention had low sound noise.

Example 6

An amorphous alloy ribbon as wide as 25 mm and as thick as 23 μm having a composition comprising 11 atomic % of B, and 9 atomic % of Si, the balance being Fe and inevitable impurities, was produced by a single roll method in the air. A freely solidified surface of this alloy ribbon had reflectance R of 72.1% to light having a wavelength of 1000 nm. As shown in FIG. 1, laser beam pulses having a wavelength of 1065 μm, a pulse width of 500 ns and a beam diameter of 60 μm were supplied from a fiber laser 10 via a galvanometer scanner (mirror) 14, to scan the freely solidified surface of this amorphous alloy ribbon with irradiation energy densities of 2.7 J/cm$^2$, 3.0 J/cm$^2$, 6.2 J/cm$^2$ and 11.2 J/cm$^2$, respectively, in a transverse direction, thereby forming transverse lines of recesses having various number densities n of recesses with longitudinal intervals of 5 mm. Each alloy ribbon was cut to 120 mm, and heat-treated at 350° C. for 1 hour in a magnetic field of 1.2 kA/m in the longitudinal direction of the ribbon to provide a single-plate sample, whose iron loss P (W/kg) and apparent power S (VA/kg) were measured at 50 Hz and 1.3 T.

Figure 9:
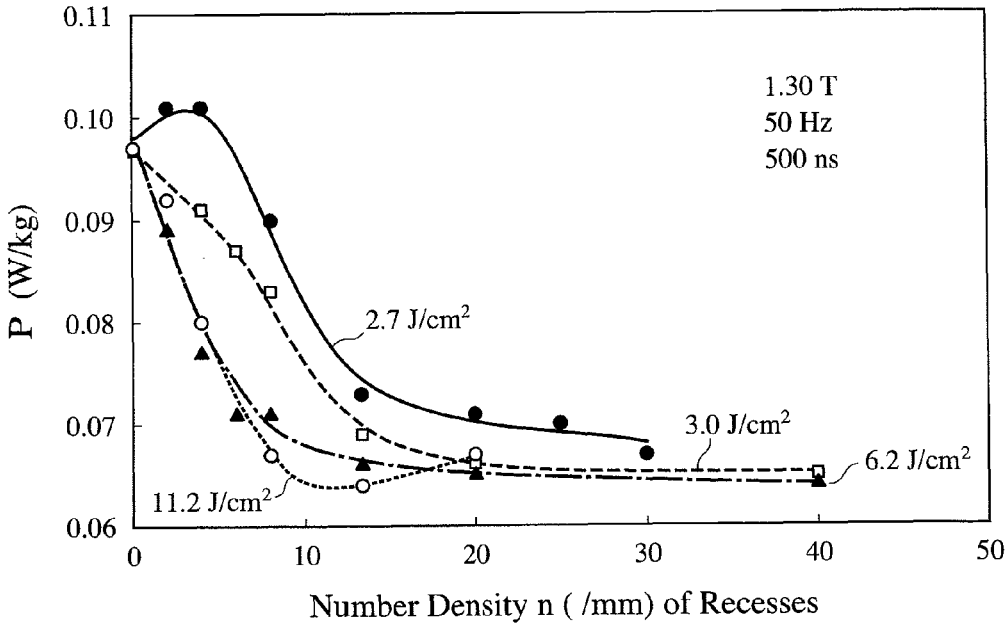
FIG. 9 is a graph showing the relation between the number density n of recesses and iron loss P in a soft-magnetic, amorphous alloy ribbon.

FIG. 9 shows the relation between the core loss P and the number density n (/mm) of recesses at each irradiation energy density. As is clear from FIG. 9, as n increased, the iron loss P decreased, and the larger the energy density became, the more the iron loss P decreased. The formation of recesses dividing magnetic domains leads to lower iron loss P. Thus, a small number density n of recesses provides a relatively high iron loss P, and increase in the number density n of recesses results in the decrease of the iron loss P. However, when the number density n of recesses is more than 20, the effect of dividing magnetic domains is saturated, making it difficult to reduce the iron loss P. At an irradiation energy density of up to 6.2 J/cm$^2$, the iron loss P does not increase even if the number density n of recesses is more than 20. However, at an irradiation energy density of 11.2 J/cm$^2$, the iron loss P increased when the number density n of recesses exceeded about 12. This is in agreement with the tendency shown in FIG. 8, in which at an irradiation energy density providing annular projections having a height $t_2$ exceeding about 2.5 μm, the iron loss P rather increases.

Figure 10:
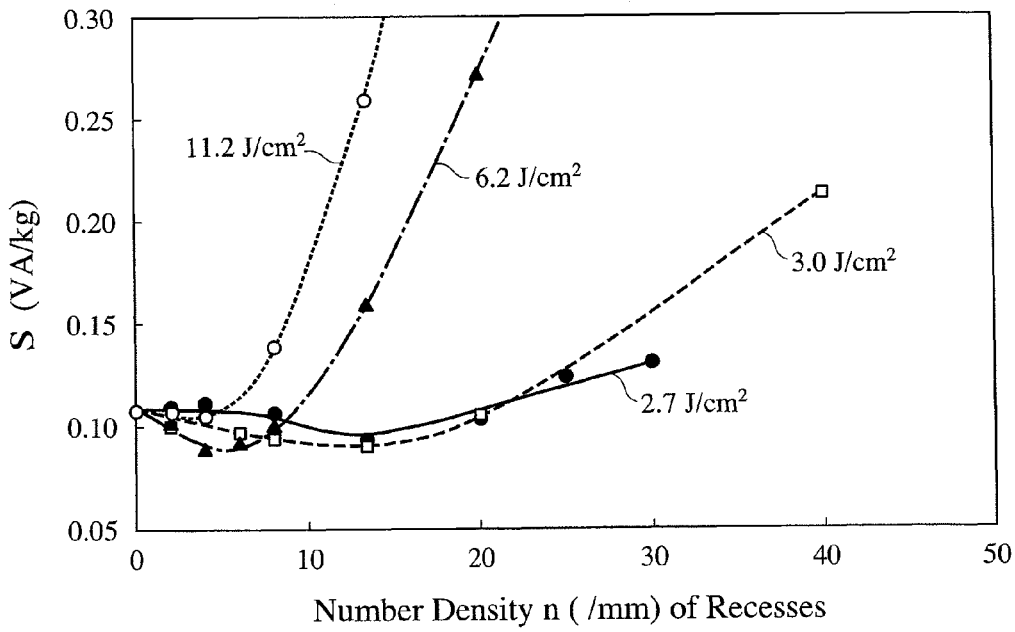
FIG. 10 is a graph showing the relation between the number density n of recesses and apparent power S in a soft-magnetic, amorphous alloy ribbon.

FIG. 10 shows the relation between the number density n (/mm) of recesses and the apparent power S. As n increases at each energy density, the apparent power S tends to decrease and then increase. Because of the division of magnetic domains, stress has larger influence than the apparent power S. Because the division of magnetic domains results in decreased iron loss P, the apparent power S decreases as the iron loss P decreases. Also, magnetic domains having a magnetization direction in the depth direction are formed because of stress in the recesses, resulting in increased apparent power S. The decrease of the apparent power S due to the decrease of the iron loss P and the increase of the apparent power S due to stress occur simultaneously, so that increase in the apparent power S is suppressed while the iron loss P is decreasing, and the apparent power S increases after the decrease of the iron loss P stops. This tendency is shown in FIG. 10. The number density n of recesses providing low iron loss and low apparent power is substantially 2-20/mm. At any irradiation energy density, the apparent power S increases when the number density n of recesses exceeds about 5, at a rate decreasing as the irradiation energy density becomes smaller. Accordingly, within a range providing a sufficient effect of decreasing the iron loss P, the irradiation energy density is preferably as small as possible to suppress increase in the apparent power S. Specifically, as shown in FIG. 5, the irradiation energy density is preferably 5 J/cm$^2$ or less and 2 J/cm$^2$ or more, more preferably 2.5-4 J/cm$^2$.

Example 7

Figure 11:
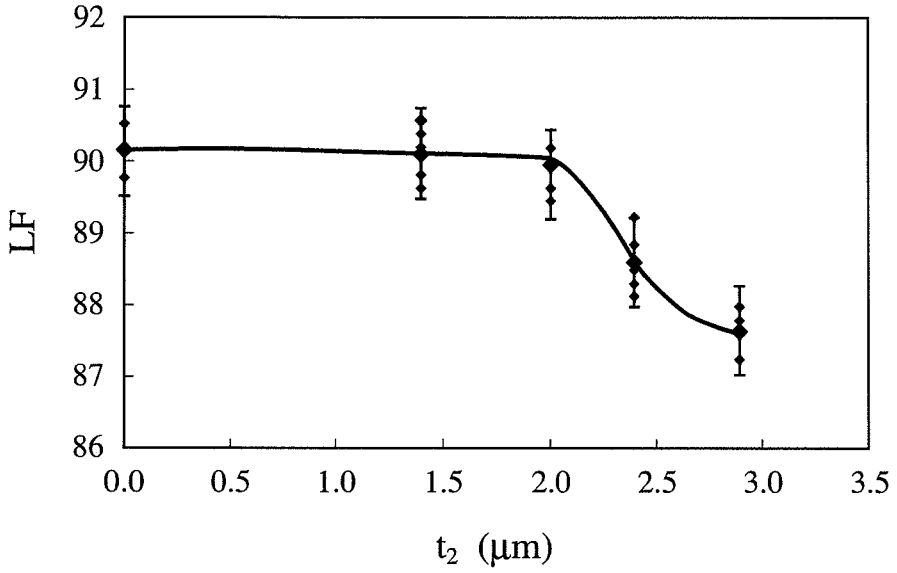
FIG. 11 is a graph showing the relation between a lamination factor LF and the height $t_2$ of annular projections in a soft-magnetic, amorphous alloy ribbon.

Annular projections having various heights $t_2$ were produced with different irradiation energy densities of laser beam pulses applied to the same amorphous alloy ribbon as in Example 1. FIG. 11 shows the relation between the lamination factor LF and the height $t_2$ of doughnut-shaped projections around the recesses. The lamination factor LF is a ratio of the cross section area of ribbons to that of a ribbon laminate; the closer it is to 1, the higher the ratio of ribbons in the laminate. Higher LF provides smaller magnetic cores comprising laminated soft-magnetic, amorphous alloy ribbons. In this Example, the number of lamination was 20. As is clear from FIG. 11, when the height $t_2$ of doughnut-shaped projections exceeds 2 μm, the lamination factor LF decreased drastically.

EFFECT OF THE INVENTION

Since the soft-magnetic, amorphous alloy ribbon of the present invention has doughnut-shaped projections having smooth surfaces substantially free from molten alloy splashes, around recesses formed by the irradiation of laser beams, the height $t_2$ of the doughnut-shaped projections being 2 μm or less, and a ratio $t_1/T$ of the depth $t_1$ of the recesses to the thickness T of the ribbon being in a range of 0.025-0.18, it has low iron loss and apparent power as well as a high lamination factor. Because laminate cores and wound cores formed by laminating or winding such soft-magnetic, amorphous alloy ribbons have high efficiency because of low iron loss, and small sound noise because of low apparent power, they are suitable for distribution transformers, high-frequency transformers, saturable reactors, magnetic switches, etc.

What is claimed is:

1. A soft-magnetic, amorphous alloy ribbon produced by a rapid quenching method, having transverse lines of recesses formed on its surface by laser beams with predetermined longitudinal intervals, with a doughnut-shaped projection formed around each recess; said recesses and said doughnut-shaped projections being constituted by an amorphous phase; said doughnut-shaped projections having smooth surfaces substantially free from splashes of the alloy melted by the irradiation of laser beams, and a height $t_2$ of 2 μm or less; and a ratio $t_1/T$ of the depth $t_1$ of said recesses to the thickness T of said ribbon being in a range of 0.025-0.18, wherein the number density of said recesses in the transverse lines is 2-20/mm, and wherein a surface of said ribbon to be irradiated with laser beams has reflectance of 15-80% at a wavelength λ of 1000 nm.

2. The soft-magnetic, amorphous alloy ribbon according to claim 1, wherein the openings of said recesses are substantially circular.

3. The soft-magnetic, amorphous alloy ribbon according to claim 1, wherein the height $t_2$ of said doughnut-shaped projections is 0.5-2 μm.

4. The soft-magnetic, amorphous alloy ribbon according to claim 3, wherein the height $t_2$ of said doughnut-shaped projections is 0.5-1.8 μm.

5. The soft-magnetic, amorphous alloy ribbon according to claim 1, wherein a ratio $t_1/T$ of the depth $t_1$ of said recesses to the thickness T of the ribbon is in a range of 0.03-0.15.

6. The soft-magnetic, amorphous alloy ribbon according to claim 1, wherein the thickness T of said ribbon is 30 μm or less.

7. The soft-magnetic, amorphous alloy ribbon according to claim 1, wherein a ratio t/T of the total t of the depth $t_1$ of said recesses and the height $t_2$ of said doughnut-shaped projections to the thickness T of said ribbon is 0.2 or less.

8. The soft-magnetic, amorphous alloy ribbon according to claim 1, wherein said soft-magnetic, amorphous alloy ribbon is made of an Fe—Si—B alloy.

9. A magnetic core obtained by laminating or winding the soft-magnetic, amorphous alloy ribbon recited in claim 1.

10. The magnetic core according to claim 9, wherein said soft-magnetic, amorphous alloy ribbon is provided with said recesses, and then heat-treated in a magnetic field oriented in a magnetic path direction.

11. A method for producing a soft-magnetic, amorphous alloy ribbon, comprising irradiating a surface of a soft-magnetic, amorphous alloy ribbon produced by a rapid quenching method with laser beam pulses successively in a transverse direction with predetermined longitudinal intervals, to form transverse lines of recesses; the irradiation energy density of said laser beam pulses being controlled, such that (a) a doughnut-shaped projection is formed around each recess, that (b) said doughnut-shaped projections have substantially no molten alloy splashes to have smooth surfaces, that (c) said doughnut-shaped projections have a height $t_2$ of 2 μm or less, and that (d) a ratio $t_1/T$ of the depth $t_1$ of said recesses to the thickness T of said ribbon is in a range of 0.025-0.18, thereby dividing magnetic domains in said amorphous alloy while suppressing increase in the apparent power, said recesses and said doughnut-shaped projections being constituted by an amorphous phase, wherein the number density of said recesses in the transverse lines is 2-20/mm, and wherein a surface of said ribbon to be irradiated with laser beams has reflectance of 15-80% at a wavelength λ of 1000 nm.

12. The method for producing a soft-magnetic, amorphous alloy ribbon according to claim 11, wherein said amorphous alloy ribbon is irradiated with said laser beam pulses passing through a galvanometer scanner or a polygon scanner and a fθ lens.

13. The method for producing a soft-magnetic, amorphous alloy ribbon according to claim 11, wherein the irradiation energy density of said laser beam pulses is 5 $J/cm^2$ or less.

14. The method for producing a soft-magnetic, amorphous alloy ribbon according to claim 13, wherein the irradiation energy density of said laser beam pulses is 2-5 $J/cm^2$.

15. The method for producing a soft-magnetic, amorphous alloy ribbon according to claim 14, wherein the irradiation energy density of said laser beam pulses is 2.5-4 $J/cm^2$.

16. The method for producing a soft-magnetic, amorphous alloy ribbon according to claim 11, wherein said laser beam pulses are generated by a fiber laser.

* * * * *